United States Patent [19]

Williamson et al.

[11] 4,224,970

[45] Sep. 30, 1980

[54] COLLAPSIBLE RECEPTACLE FOR FLOWABLE MATERIALS

[75] Inventors: Robert R. Williamson; Norwin C. Derby, both of Dallas, Tex.

[73] Assignee: Super Sack Manufacturing Corporation, Dallas, Tex.

[21] Appl. No.: 952,335

[22] Filed: Oct. 18, 1978

Related U.S. Application Data

[63] Continuation-in-part of Ser. No. 813,634, Jul. 7, 1977, Pat. No. 4,143,796.

[51] Int. Cl.[3] ..... B65D 29/00; B65D 29/02

[52] U.S. Cl. ..... 150/1; 112/419; 112/440; 229/55

[58] Field of Search ..... 220/1, 12, 17, 2; 222/185, 181; 112/137, 418, 419, 440; 150/1, 12; 229/55

[56] References Cited

U.S. PATENT DOCUMENTS

| | | | |
|---|---|---|---|
| 546,168 | 9/1895 | Lobdell | 150/12 |
| 616,249 | 12/1898 | Nickerson | 150/12 |
| 733,542 | 7/1903 | Converse | 150/1 |
| 1,308,263 | 7/1919 | Smith | 150/1 |
| 1,335,607 | 3/1920 | Salisbury . | |
| 1,815,106 | 7/1931 | Jostes | 150/12 X |
| 2,009,511 | 7/1935 | Nydesser . | |
| 2,047,095 | 7/1936 | Booth | 150/1.7 |
| 2,096,161 | 10/1937 | Curran | 150/1 |
| 2,301,128 | 11/1942 | Landefeld . | |
| 2,314,876 | 3/1943 | Greene . | |
| 2,361,943 | 12/1944 | Brandt . | |
| 2,374,929 | 2/1968 | Silverskiold . | |
| 2,507,939 | 5/1950 | Smith | 150/1 X |
| 2,691,998 | 10/1954 | Stucker | 150/11 X |
| 2,740,445 | 4/1956 | Fornell | 150/2 X |
| 2,969,102 | 1/1961 | Cunningham . | |
| 3,072,512 | 1/1963 | Dalle . | |
| 3,096,013 | 7/1963 | Kusler . | |
| 3,214,081 | 10/1965 | Silverstein | 150/12 X |
| 3,282,757 | 11/1966 | Brussee . | |
| 3,328,226 | 6/1967 | Wiley . | |
| 3,351,365 | 9/1970 | Melin . | |
| 3,430,815 | 3/1969 | Weimer . | |
| 3,540,356 | 11/1970 | Lecomte . | |
| 3,570,749 | 3/1971 | Sato . | |
| 3,581,883 | 6/1971 | Whitney . | |
| 3,589,506 | 6/1971 | Ford . | |
| 3,596,824 | 8/1971 | Lehmacher . | |
| 3,602,774 | 11/1971 | Hitchin . | |
| 3,607,616 | 9/1971 | Barbehenn . | |
| 3,623,937 | 11/1971 | Gasaway . | |
| 3,661,322 | 5/1972 | Norman . | |
| 3,666,585 | 5/1972 | Barbehenn . | |
| 3,671,383 | 6/1972 | Sakata . | |
| 3,701,559 | 10/1972 | Marino . | |
| 3,742,664 | 7/1973 | Redins . | |
| 3,754,053 | 8/1973 | Schitmer . | |
| 3,789,897 | 2/1974 | Saito . | |
| 3,798,115 | 3/1974 | Hofmann . | |
| 3,827,471 | 8/1974 | Gregory et al. | 150/2 |
| 3,865,339 | 2/1975 | Von Alven . | |
| 3,874,989 | 4/1975 | Strange . | |
| 3,893,595 | 7/1975 | Khanna et al. | 150/2 X |
| 3,961,655 | 6/1976 | Nattrass et al. | 150/1 |
| 3,982,986 | 9/1976 | Stone . | |
| 4,010,784 | 3/1977 | Nattrass | 150/12 X |

FOREIGN PATENT DOCUMENTS

| | | | |
|---|---|---|---|
| 523764 | 9/1929 | Fed. Rep. of Germany . | |
| 266810 | 2/1928 | Italy | 150/1 |
| 413476 | 12/1966 | Switzerland . | |
| 339825 | 12/1930 | United Kingdom | 150/1 |
| 360733 | 11/1931 | United Kingdom | 150/1 |
| 915999 | 1/1963 | United Kingdom | 150/1 |
| 1340693 | 12/1973 | United Kingdom . | |

*Primary Examiner*—Allan N. Shoap

*Attorney, Agent, or Firm*—Richards, Harris & Medlock

[57] ABSTRACT

A collapsible receptacle for handling flowable materials in semi-bulk quantities comprises a generally cylindrical container supported by a sling. The container features top loading and bottom discharge. The container can be constructed of a strong weave material. Preferably, the container is constructed of a unique laminate material formed of an inner liner of polybutylene film noncontinuously adhered to an outer layer of woven polypropylene. The sling is constructed of straps of polyester webbing, which are sewn to the container so that support stresses are distributed between the sling and the container. In one embodiment, the sling includes a ring for supporting the bottom of the container and lift straps attached to the ring. The ring surrounds a unique discharge spout in the container bottom. In another embodiment, the lower ends of the lift straps include guide loops for a draw rope. The draw rope surrounds a wire tie which functions to gather and close the bottom of the container. Release of the wire tie and draw rope permits discharge of the contents across the entire bottom of the container. In another embodiment, the receptacle includes a top panel, side panels and side seams between the side panels with the lift straps encompassing at least a portion of the side seams and attached to a top stitch to the top and side panels.

11 Claims, 19 Drawing Figures

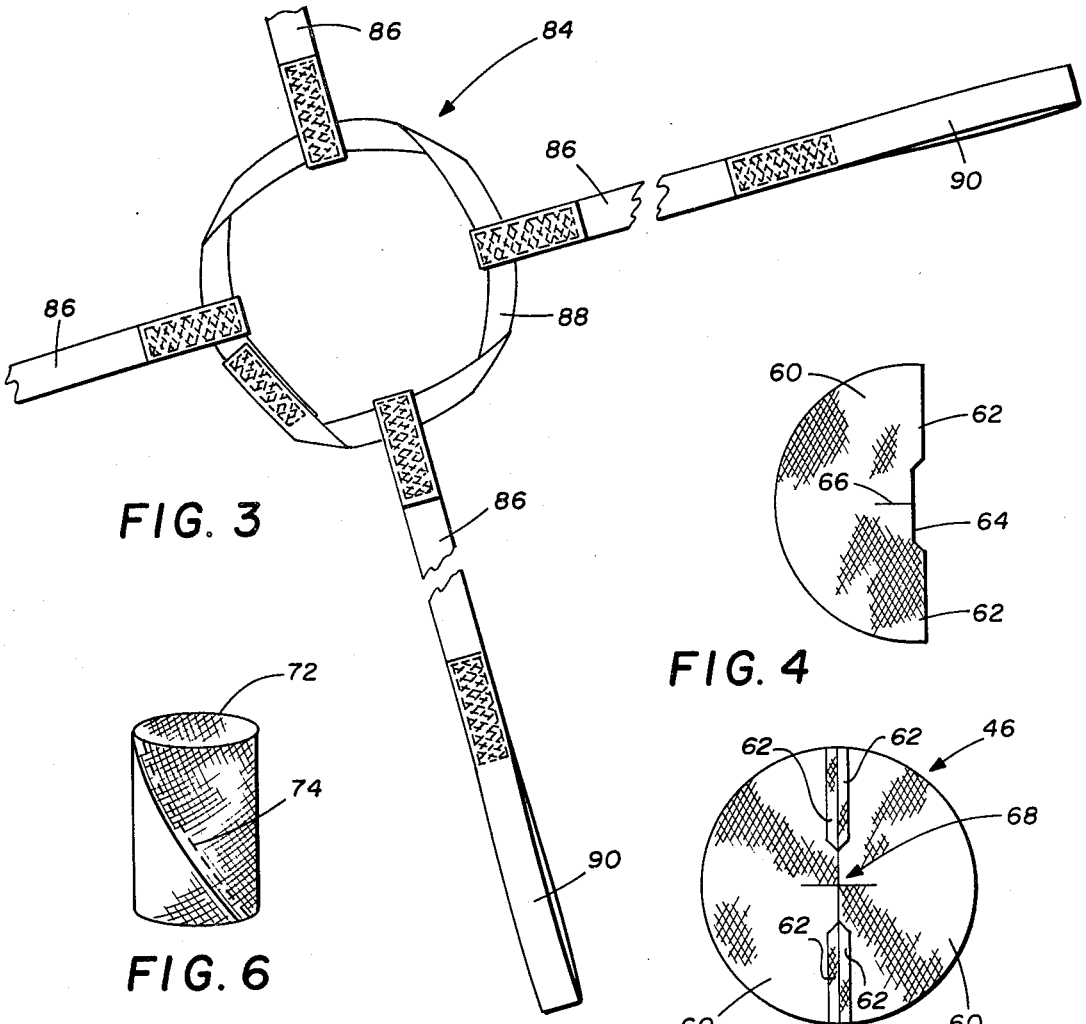
FIG. 3
FIG. 4
FIG. 6
FIG. 5
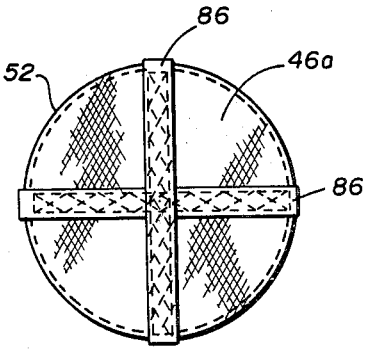
FIG. 7
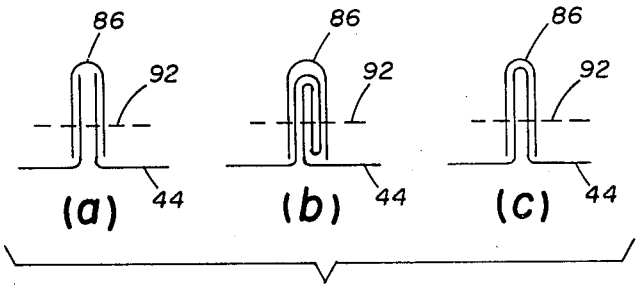
FIG. 8
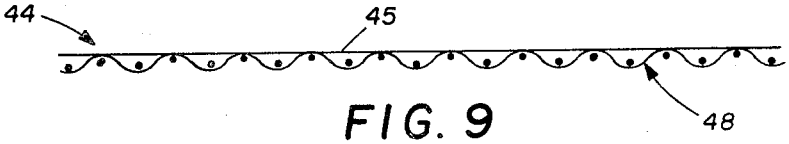
FIG. 9

COLLAPSIBLE RECEPTACLE FOR FLOWABLE MATERIALS

CROSS REFERENCE TO RELATED APPLICATION

This application is a continuation-in-part of co-pending application Ser. No. 813,634, filed July 7, 1977, now U.S. Pat. No. 4,143,796.

BACKGROUND AND SUMMARY OF THE INVENTION

This invention relates generally to receptacles for material handling, and more particularly to flexible, collapsible receptacles for use in the storage, transportation and dispensation of flowable materials in semi-bulk quantities.

Traditionally, the handling of flowable materials and specifically dry particulate or granular materials have presented unique problems. For instance these materials include chemicals, minerals, fertilizers, foodstuffs, grains, agricultural products and the like. Generally, such materials have been handled chiefly by two types of material handling systems. Where large quantities of materials are required, specialized bulk handling equipment is used. For example, materials are loaded into a truck, railroad car or barge at the supply location and then transported to a place of unloading where the materials are transferred to a hopper or other storage device. The materials are distributed from this point to the actual destination sites. Although such bulk material handling systems can efficiently transport such materials, they are limited in flexibility. The material must be handled in large quantities, and the transfer can occur only in those places convenient to these transportation systems. In addition, sanitary standards are more difficult to maintain. Since the materials are often exposed during at least part of the handling, there is always the possibility of damage or contamination. Consequently, the characteristics of the particular material involved also affect the flexibility of a bulk handling system.

Where smaller quantities of material are required, a container system is used. These packages may take the form of drums, bags, boxes, baskets or other types of individual packages. Consider the cement industry, for example. Cement, mortar and the like are loaded in paper sacks capable of containing 50 to 100 lbs. of material. The sacks are separately filled, loaded on vehicles, transported to a point of distribution, unloaded and stored in this form. At the work site, the bags are individually opened, emptied and then discarded. Despite some conveniences in using the container system, there are attendant disadvantages. The handling costs are higher, because the packages must be loaded, unloaded and emptied individually. Since numerous containers are often required, higher costs are also incurred on the basis of units of material shipped per container, and particularly if the container can be utilized but once. On the other hand, reusable packages are relatively more expensive and are frequently of rigid or noncollapsible construction whereby return freight costs can be substantial. Finally, losses from breakage, moisture or other contamination can be considerable where the containers are constructed of a porous material, such as cotton or paper.

In addition, various problems frequently arise relative to discharging the material contents from the container. Depending upon the material, interruption of the container unloading operation can result when the discharge means becomes clogged. This frequently occurs when shipping moist or compactable materials which tend to cake, or bridge across the discharge opening. This problem can be alleviated by using a larger discharge opening, however, a large discharge opening often results in a loss of control of the material discharge. Consequently, a small discharge opening allows greater control, but often requires the time consuming, and therefore, costly step of clearing blockages.

The present invention comprises a material receptacle which overcomes the foregoing and other problems long since associated with the prior art. The present invention utilizes a new and improved flexible receptacle for handling materials in semi-bulk quantities which incorporates the convenience of a package container system with the economy of the bulk shipping system. In accordance with the broader aspects of the invention, an improved flexible receptacle comprises a unique sling and woven container arrangement. The container features top loading and bottom discharge. The receptacle can be used with virtually any flowable material, such as minerals, chemicals, fertilizers, foodstuffs and agricultural products. The receptacle of the present invention can be easily transported or handled by one individual with appropriate equipment even though the weight capacity can be as high as 3,000 lbs. or more. Pallets are not necessary, thereby reducing the tare weight and increasing the shipping efficiency. Because the receptacle is constructed from a durable, laminate material, it can be transported or stored in an exposed condition without damage to the contents. The receptacles can be stacked for high density storage or transportation, which further increases shipping efficiency. The top loading and bottom discharge features of the receptacle provide advantages to both the vendor and the user of the contents. Gravity fill and discharge are facilitated. The receptacle can be used as a dispenser and functions as a hopper when supported. Finally, the flexible receptacle comprising the invention is completely collapsible and can be reused if desired.

In accordance with more specific aspects of the invention, a semi-bulk receptacle for flowable materials comprises a woven container supported by a sling assembly. The container includes a bottom portion and an upstanding side portion. The side portion is formed from one or more panels sewn together at the vertical edges. The lower edge of the cylindrical side portion is sewn to the periphery of the bottom portion, which includes a discharge spout and closure therefor. The side and bottom portions of the container are preferably formed of a unique laminate material which consists of an outer layer of woven polypropylene adhesively secured to an inner layer of polybutylene film. The woven polypropylene affords great strength and durability, while the polybutylene film serves as a flexible moisture barrier, whereby the contents of the receptacle are protected from damage during handling and transit. Other woven materials with sufficient strength can be used, if desired, to construct the container. The sling assembly, which is preferably constructed of polyester webbing, supports the collapsible container. The sling comprises lift straps attached to a bottom ring. Specifically, four lift straps are secured to the bottom ring at equal intervals. With the ring surrounding the discharge spout, part of the support sling is sewn to the bottom portion of the container. The sling assembly is also sewn through the lift straps to the side portion of the container. Each lift strap is folded over the adjacent container side portion and sewn continuously along the vertical distance between the bottom and the fill height of the container. As a result, the stress is more evenly distributed between the support sling and the durable container material. In addition, supporting the receptacle by the sling aids discharge; by tending to squeeze the container, the sling reduces material bridging across the discharge spout. To allow top loading of the receptacle, the top of the container can be gathered and closed with a removable wire tie, or provided with a spout similar to the discharge spout.

In another embodiment of the invention, the container comprises only an upstanding side portion formed from one or more panels of woven material sewn together at the edges. The edges of the container are gathered and closed with wire ties. The sling assembly comprises four lift straps sewn to the container. Each lift strap includes a lift loop at the upper end and a guide loop at the lower end. A draw rope passing through the guide loops surrounds the bottom wire tie and supports the bottom of the container. Release of the lower wire tie and draw rope permits full open discharge of the container without interruption due to materials bridging or clogging.

In another embodiment of the invention, the container has upper and lower ends and defines a collapsible chamber. A plurality of side panels forms a side wall of the container and are defined by a plurality of side seams extending between adjacent side panels from the upper to the lower end of the container. Side seam flaps extend along each of the side seams and extend outwardly from the container. A top panel is sewn on the upper end of the container by a top seam extending along the upper edge of the side panels and along the outer edge of the top panel to form a closed upper end. The side seam flaps are folded at their upper ends against the side panels and are sewn thereto. The top panel also includes a closeable opening for introducing flowable materials into the container.

Lift straps are folded lengthwise and positioned encompassing each of the side seam flaps, and strap stitches secure the straps to the seam flaps along at least a portion of the side seam flaps. The strap stitches extend from the lower end of the container to a point located a predetermined distance below the upper end of the container, and a portion of the straps extends beyond the upper end of the container for applying a lifting force to the container. The straps are unfolded along the predetermined distance and are sewn to the upper end of the container by top stitches that extend through the outer edge of the top panel, the upper edge of the side panels, the side seams, the side seam flaps and the straps. The straps are operable to distribute lifting forces along the side panels, and the top stitches resist oblique forces applied through the upper portions of the straps in a direction oblique to the side panels to prevent the straps from being torn away from the side seam flaps by the oblique forces.

DESCRIPTION OF THE DRAWINGS

A more complete understanding of the invention may be had by reference to the following Detailed Description when taken in conjunction with the accompanying Drawings, wherein:

FIG. 3 is an enlarged partial plan view of the support sling of the receptacle shown in FIG. 1;

FIG. 4 is a reduced plan view of half of the bottom portion of the invention;

FIG. 5 is a reduced plan view of the bottom sack portion of the invention;

FIG. 6 is a perspective view of a portion of the discharge spout of the invention;

FIG. 7 is a reduced bottom plan view of a first modification of the receptacle shown in FIG. 1;

FIG. 8 is a diagram of three types of seams utilized in the invention;

FIG. 9 is an enlarged section view illustrating the laminate construction of the sack portion of the invention;

DETAILED DESCRIPTION

Figure 1:
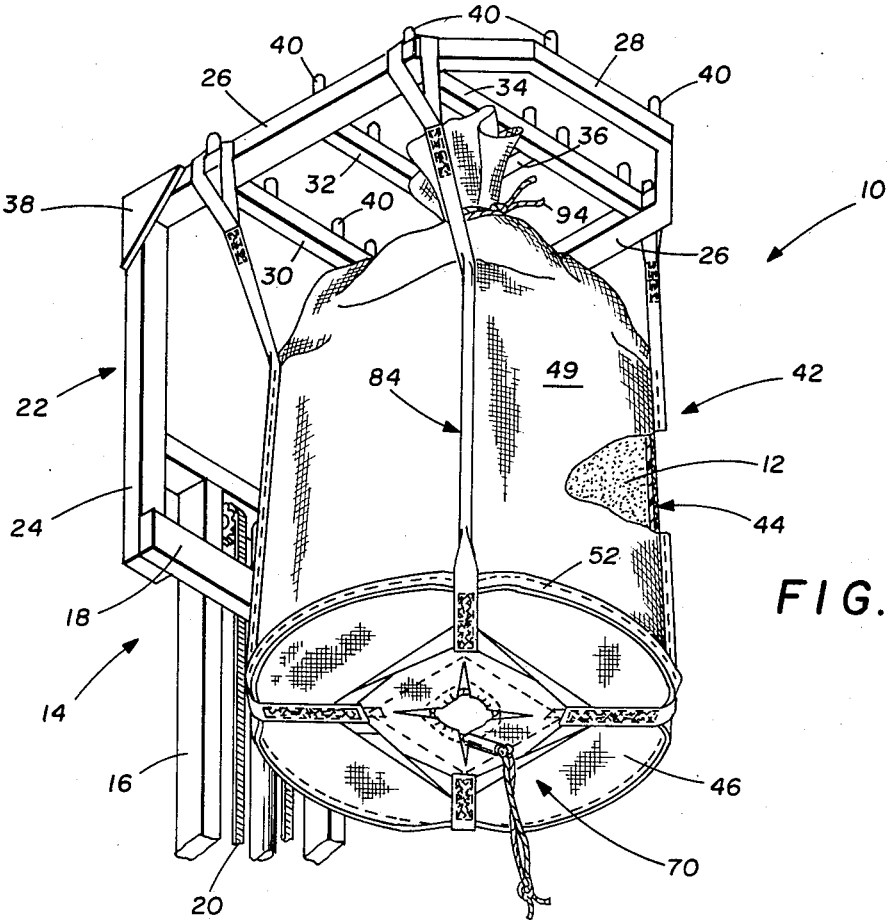
FIG. 1 is a bottom front perspective view if a semi-bulk flexibie receptacle incorporating the invention in which certain parts have been broken away to illustrate more clearly certain features of the invention.

Referring now to the Drawings wherein like reference characters designate like or corresponding parts throughout the several views, and particularly referring to FIG. 1, there is shown a receptacle 10 incorporating the invention. Receptacle 10 is of flexible, collapsible construction and can be utilized during all phases of material handling in semi-bulk quantities. Receptacle 10 can be used for storing, transporting or dispensing flowable material 12 such as minerals, chemicals, fertilizers, foodstuffs or agricultural products.

The receptacle 10 is shown supported from a forklift assembly 14. Forklift assembly 14 includes a mast 16 supported from and extending vertically upward from the front of a conventional forklift (not shown). Mast 16 supports a crossbar 18 which is vertically movable with respect to the mast by means of a chainlift assembly 20. Other types of fork trucks with other types of lift assemblies could also be utilized.

Attached to crossbar 18 is a unique fork truck attachment 22. Attachment 22 includes two columns 24 vertically extending in spaced relationship from crossbar 18. Beams 26 extend substantially horizontally in spaced relationship from the upper ends of columns 24. Front frame 28 interconnects the front ends of beams 26. Cross beams 30, 32 and 34 further interconnect horizontal beams 26 by extending therebetween. A short cross member 36 in turn connects cross beams 32 and 34. Gussets 38, only one of which is shown, are provided for additional strength and rigidity at the respective joints between columns 24 and beams 26. In addition, a plurality of upstanding pegs 40 are spaced about the upper surface of fork truck attachment 22. In the preferred embodiment, pegs 40 are constructed from bar stock and welded to the upper surface of attachment 22. Receptacle 10 is shown supported from pegs 40.

Receptacle 10 includes a container portion 42 which defines a generally cylindrical volume for retaining flowable material 12. In particular, container 42 is constructed of material 44. With reference to FIG. 9 in conjunction with FIG. 1, material 44 comprises a unique laminate having inner film layer 45 and an outer weave layer 48. In the preferred embodiment, the outer layer 48 consists of 16×15 weave polypropylene material of the type manufactured by Plymouth Patchogue, a division of Amoco Corporation. The polypropylene weave comprising outer layer 48 is woven straight and used straight, as opposed to biased, in container portion 42. The inside layer 45, which is preferably polybutylene film of about 0.5 mil to 4.0 mil thickness, is attached to one side of the outer weave 48 by means of resin adhesive. A kiss coating of adhesive applied in a manner well known in the prior art is used to secure layers 45 and 48, so that attachment occurs only between the raised portions of weave 48 and the adjacent spots on film 45. As used herein, the term "kiss coating" means any conventional process by which a relatively thin layer of adhesive can be applied to a surface. For example, a suitable coating of adhesive can be applied by passing weave layer 48 over a roller partially submerged in a bath of suitable liquid adhesive. It will be understood that application of adhesive to weave layer 48 by means of conventional kiss coating techniques deposits adhesive onto only the raised woven portions of layer 48. Consequently, film 45 and weave 48 are not attached continuously over their entire areas, but rather are attached only at spaced points therebetween.

The feature of noncontinuously attaching polybutylene film to one side of woven polypropylene to form material 44 comprises a significant aspect of the present invention. Liners are often required when shipping powdered materials, such as flour or powdered sugar, to prevent the powdered contents from sifting through a relatively porous container, or to prevent contamination thereof by the container. In the past, such impermeable liners have been provided either independently or integrally by means of extrusion laminates. Independent liners are inconvenient, because they must be placed separately within a container and are frequently nonreusable. On the other hand, containers constructed of integral extrusion laminates suffer from other problems. In an extrusion laminate, the layers are bonded continuously over entire adjacent surfaces. This requires that the properties of the materials constituting the layers be closely matched. In particular, a brittle material with poor fatigue characteristics could not be extrusion laminated to a pliable material for an application involving folding or bending, even though other properties of the brittle material might make it desirable. Material 44 is far superior to conventional extrusion laminates for utilization as the wall material in a receptacle for flowable materials because polybutylene film is a high stretch material and the only polyolefin film with the temperature, stress and strain characteristics to be uniquely compatible with polypropylene. On the other hand, woven polypropylene is highly durable and has an attractive strength/weight ratio. If formed into a film, polypropylene would be too brittle for use in flexible receptacle 10.

Kiss coating polybutylene film to woven polypropylene permits each layer to perform its intended function independently. Outer weave layer 48 is tough, durable and resistant to punctures, tears and scrapes incurred during handling of receptacle 10. However, were a minor puncture to occur, the pliable inner film layer 45 would independently stretch or hernia out and resist damage. This would not occur if the wall material were extrusion laminated, because puncturing the outer layer would simultaneously puncture the inner layer of an extrusion laminate. Of course, it will be understood that even greater durability and strength can be achieved by doubling outer weave layer 48 prior to kiss coating a film layer 45 to one surface of one layer thereof, if desired.

Although material 44 has been described above as preferably comprising a laminate of polypropylene weave and polybutylene film, it will be understood that the invention is not so limited. Depending upon the sifting characteristics of the contents, or if a moisture barrier is unnecessary, a liner may not be required. Virtually any woven material, either synthetic or natural, can be used for the outer layer providing it possesses the necessary strength. Such woven materials may include, for example, jute, cotton, polyester or polypropylene.

Figure 13:
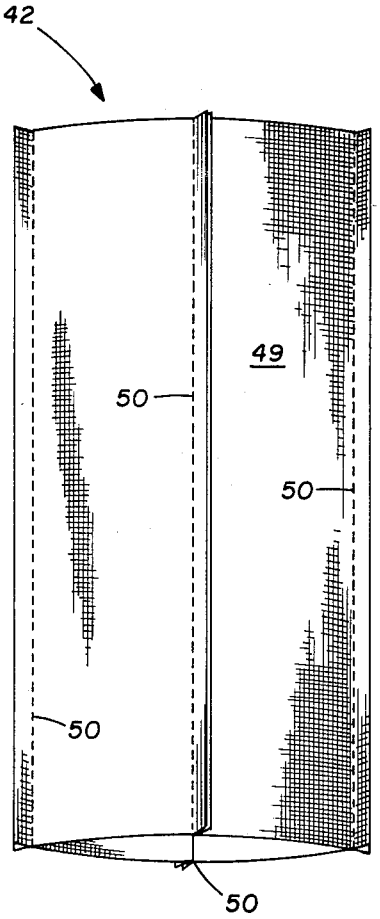
FIG. 13 is an enlarged elevational view of the container of the receptacle shown in FIG. 1.

Container portion 42 of receptacle 10 comprises a bottom 46 and side wall 49. Side wall 49 is formed by joining the edges of at least one panel of material 44, as is shown in FIG. 13. In the case of one panel of material 44, a rectangular piece is laid out and cut straight, which is to say that the cut lies substantially perpendicular to either the warp or fill of the material. The piece is rolled into a tube having a generally cylindrical configuration. The edges of the single panel of laminate material 44 comprising side wall 49 are connected by means of sewing. A seam, such as a plain seam 50, wherein adjacent pieces of material are joined by stitching the pieces along a line equidistant from the free edges, is sewn extending the length of the completed side wall 49. Seams having a more pleasing appearance can also be used, but are not required. If desired, more than one rectangular panel of material 44 may comprise side wall 49, provided that each piece is of substantially identical area. Preferably, no more than four like panels of material 44 are used, thereby keeping the number of seams 50 therebetween to a minimum. Minimizing the number of seams in container portion 42 increases the structural integrity of receptacle 10. The lower edge of side wall 49 is then sewn about the periphery of bottom 46 to complete the construction of container portion 42. A plain seam 52 can be used, however, other more aesthetic seams can be used if desired.

Bottom 46 comprises two semicircular pieces 60, as is perhaps best shown in FIGS. 4 and 5. Both semicircular pieces 60 are of identical construction. Each piece 60 is cut so as to leave seam allowances 62 on either side of edge 64. A cut 66 extends substantially perpendicularly from edge 64 in each semicircular piece 60. Two pieces 60 are joined by sewing only along the seam allowances 62 to complete bottom 46. After two pieces 60 are thus joined by sewing together corresponding seam allowances 62, the free edges 64 are bisected by cuts 66 to define a crosscut positioned centrally in bottom 46. FIG. 5 shows pieces 60 stitched together with a plain seam, and with seam allowances 62 open. With semicircular pieces 60 thus cut and joined, an opening 68 remains in bottom 46. Opening 68 is defined by the flaps resulting from cuts 66 and edge 64 in semicircular pieces 60.

Figure 2:
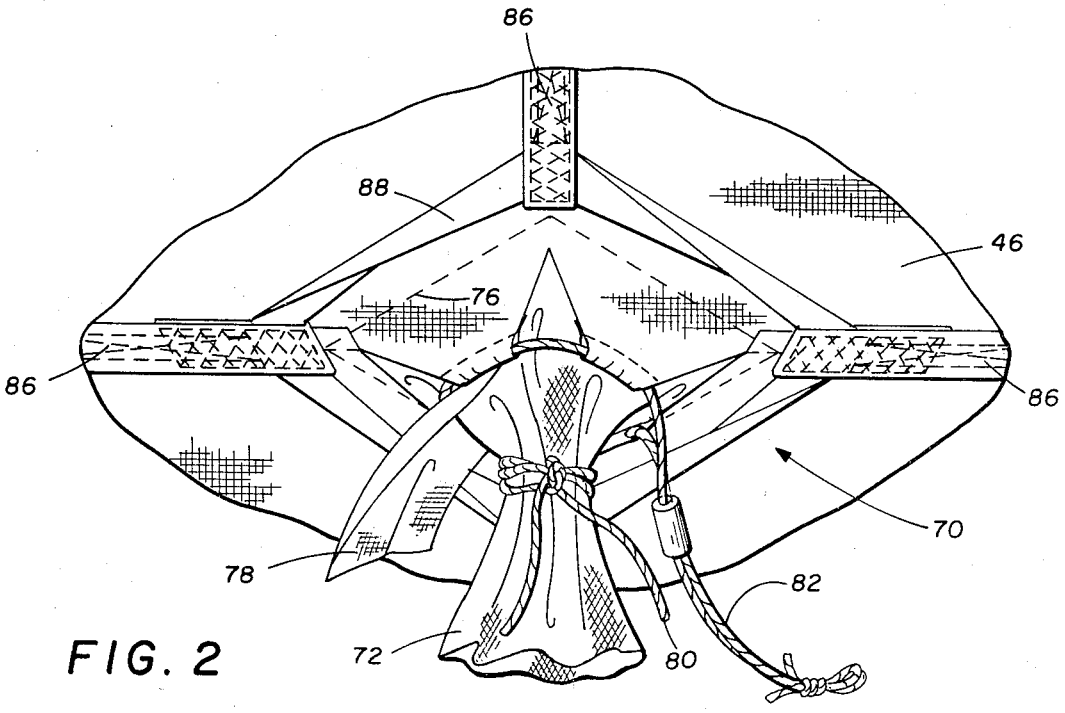
FIG. 2 is an enlarged bottom front perspective view of the discharge spout of the receptacle shown in FIG. 1.
Figure 10:
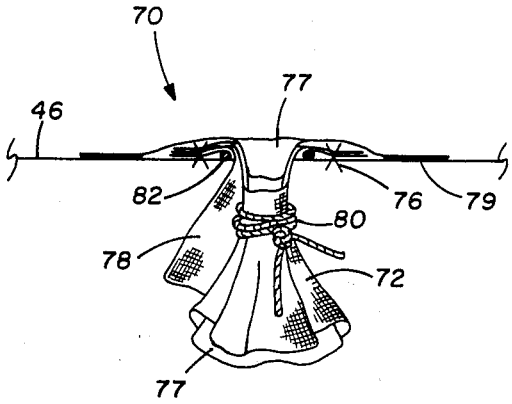
FIG. 10 is a partial section view of the discharge spout shown in FIG. 2.

Referring now to FIGS. 2 and 10 in conjunction with FIG. 1, bottom 46 of receptacle 10 includes a discharge spout assembly 70. FIG. 1 depicts discharge spout assembly 70 in an unextended condition, while FIGS. 2 and 10 illustrate assembly 70 in a secured, extended condition ready for discharge. Spout assembly 70 is located in the approximate center of bottom 46 and extends through opening 68 therein. In particular, spout assembly 70 includes spout 72. Preferably, spout 72 is formed by cutting a rectangular piece of woven material on a bias, rather than straight. The rectangular piece of woven material is then rolled into a cylinder as shown in FIG. 6. The edges of the material are overlapped and sewn along line 74 to complete spout 72. It is important that spout 72 be formed of woven material laid and cut on a bias so that the spout will have the desired flexibility. In this regard, it is pointed out that spout 72 is not constructed of a laminate material, such as that described above, but is preferably formed only of a weave. Spout 72 is placed within opening 68 and sewn about the periphery of one end to bottom 46. Dotted line 76 in FIG. 2 denotes the approximate sew line between spout 72 and bottom 46. Dotted line 76 is represented by an X in FIG. 10. As the end of spout 72 is sewn to bottom 46, it is preferably stretched to provide a somewhat larger inlet for the discharge of materials 12 from receptacle 10. Such a configuration is considerably facilitated by the biased cutting of woven material comprising spout 72. Closure flap 78 is inserted within opening 68 beside spout 72 and sewn to bottom 46. If desired, flap 78 can be sewn to bottom 46 concurrently with spout 72. Also, a tubular liner 77 formed of polybutylene film, for instance, can be placed within spout 72 and glued around the periphery 79 thereof to the inside surface of bottom 46. Such a liner 77 in spout 72 aids discharge of powdered materials, and when rolled up tight serves to prevent moisture leakage into or out of container portion 42 through bottom 46. Tie cord 80 serves to secure spout 72. When a liner 77 is used within spout 72, the liner is first closed by rolling and/or tying before spout 72 is tied with cord 80. After cord 80 is tied, spout 72 is rolled up and covered by closure flap 78 tucked inside the flaps of opening 68. Draw cord 82 then serves to complete the securing of discharge spout assembly 70. Consequently, there is provided a simplified discharge means for receptacle 10 which can be manipulated by one individual. Discharge spout assembly 70 is simply constructed to remain tightly closed by a combination of rolling, tying and covering; yet by simple manipulation is readily made available for discharge.

With reference to FIG. 3, there is shown the sling assembly 84 which serves to support container portion 42. Sling assembly 84 comprises lift straps 86 connected to ring 88. In accordance with the preferred embodiment, sling assembly 84 is constructed entirely from two inch wide polyester webbing. Ring 88 is formed by overlapping the ends of a sufficient length of webbing to form a ring having an inside diameter of about 14 inches. Before the overlapping ends of ring 88 are sewn together, the webbing is preferably twisted, so that the stress around ring 88 will be distributed evenly across the width of the webbing. Four lift straps 86 are then secured to ring 88 at about 90 degree intervals thereround. Each lift strap 86 is formed from a sufficient length of webbing, one end of which is passed around ring 88 to approximately a six inch overlap, and then sewn. The top end of each lift strap 86 is looped and sewn to form a lift loop 90. Consequently, sling assembly 84 is formed by cutting and sewing only five lengths of readily available webbing material.

With reference once more to FIGS. 1 and 2, sling assembly 84 is positioned in surrounding relationship to container portion 42. Ring 88 is located concentrically with respect to discharge spout assembly 70. Sling assembly 84 is attached to bottom 46 by sewing the lower portions of lift straps 86 thereto. Alternately, the straps 86 are glued to bottom 46 so that no pin holes are formed in the bottom 46. In accordance with the preferred construction, sling assembly 84 is first positioned with respect to bottom 46, so that opposite lift straps 86 overlay seam allowances 62. In this manner, sewing the lower portion of sling assembly 84 to bottom 46 simultaneously serves the purpose of reinforcing the construction of bottom 46. Thus, the lower portion of sling assembly 84 is firmly secured to and supports the bottom of container 42 with discharge spout 70 extending through ring 88.

Sling assembly 84 is also attached along the upper portions of lift straps 86 to the vertical side wall 49 of container 42. In particular, each lift strap 86 is sewn to side wall 49 substantially continuously between the bottom edge thereof and the receptacle fill height with one of the seam constructions illustrated in cross-section in FIG. 8. The stitch line is denoted by dotted line 92 throughout FIG. 8. Where four connected panels of material 44 comprise side wall 49, each lift strap 86 is preferably attached as illustrated in FIG. 8(*a*). Each lift strap 86 is wrapped around the seam between adjacent pieces of material 44 and sewn along line 92. As a result, this preferred attachment of lift straps 86 simultaneously reinforces the seams in container 42. If less than four equal panels of material 44 are sewn together to form side wall 49, at least one of the lift straps 86 is attached as illustrated in FIG. 8(*c*). In this case, the lift strap 86 is wrapped over a pinched or folded portion of material 44 and sewn along line 92. It will be apparent that utilization of constructions (a) and (c) of FIG. 8 results in sewing double thicknesses of lift straps 86 to double thicknesses of wall material 44 by means of a single line of stitching. Lift straps 86 can be secured to four layers of material 44 by use of the seam construction illustrated in FIG. 8(*b*). Any of these methods of sewing lift straps 86 to container 42 is advantageous, because a substantial part of the load supported by sling assembly 84 is distributed to the container 42. In addition, lift straps 86 can be double sewn in the vicinity of the receptacle fill height, since tearing would occur at these points first. Thus, sling assembly 84 as well as container 42 cooperate to make a high strength, low weight, collapsible receptacle 10.

Referring again to FIG. 1, the top end of container 42 is shown gathered and tied with wire tie 94. The inner layer of material 44 is first rolled down before the outer layer is secured with wire tie 94. This provides a weather tight closure whereby receptacle 10 can be stored or transported in an exposed condition without damaging the contents. Of course, the use of wire tie 94 is only one and perhaps the simplest manner of closing the loading end of receptacle 10. If desired, a fill spout assembly similar to discharge spout assembly 70 could be used.

Turning now to FIG. 7, there is shown an alternate configuration for the bottom of container 42. In this modification, bottom 46*a* is constructed of one circular piece of material 44. No discharge spout is provided, so lift straps 86 are positioned in crossing relationship and sewn to bottom 46*a* without ring 88. To remove the contents from a receptacle 10 incorporating this modification, a sharp object such as a knife is inserted through bottom 46*a*. It will be understood that container 42 can be supported by separate lift straps 86 secured only to side wall 49, if desired. This construction would be most advantageously utilized where bottom support of container 42 is unnecessary. Such a situation might arise where relatively low density materials or low weights of materials are shipped.

Figure 11:
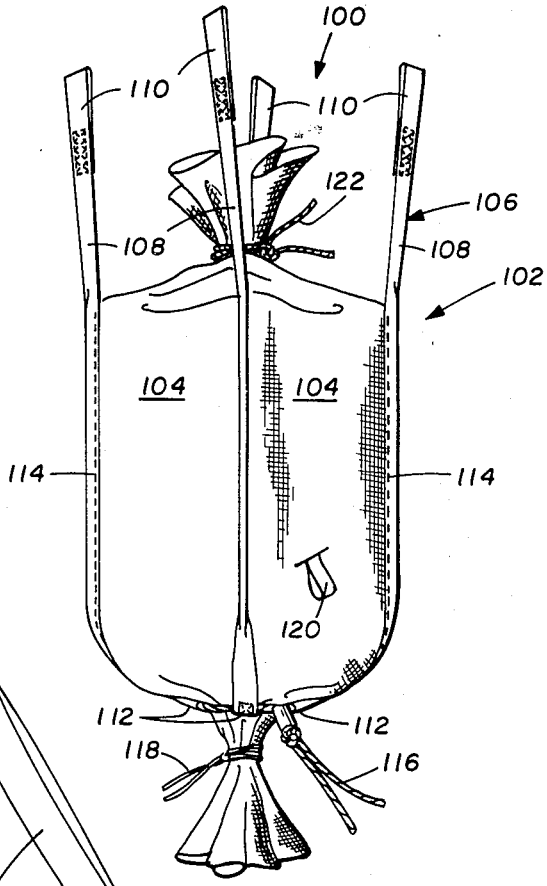
FIG. 11 is an elevational view of another embodiment of a semi-bulk flexible receptacle incorporating the invention.

Referring to FIG. 11, there is shown a receptacle 100 incorporating another embodiment of the invention. Receptacle 100 is of flexible, collapsible construction and can be utilized during all phases of material handling in semi-bulk quantities. Receptacle 100 is particularly useful in handling flowable materials which tend to cake, mat, bridge or otherwise clog a discharge opening. Such materials may be relatively coarse, moist or compactable, such as, for instance, paper scrap.

Receptacle 100 includes a container portion 102 which defines a generally cylindrical volume for retaining the contents. Container 102 may be constructed or virtually any woven material, either synthetic or natural, providing it possesses the necessary strength. Preferably, container 102 is constructed of material 44 comprising a laminate of polypropylene weave and polybutylene film. In particular, container 102 is formed by connecting the edges of four rectangular panels 104 in a manner similar to that described with reference to receptacle 10. The panels 104 are joined at the edges by sewing with, for example, a plain seam. Each panel 104 is of sufficient length, so that the ends of container 102 can be gathered and tied. Each panel 104 is laid and cut straight, as opposed to on a bias. It will be understood that one panel 104 or a plurality of panels 104 can be joined at the edges to form container 102, if desired.

Figure 12:
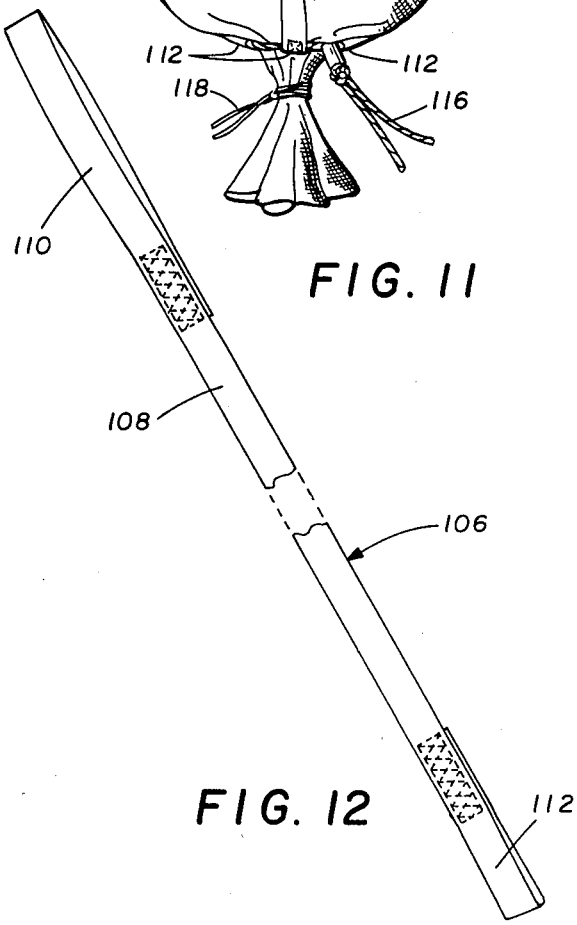
FIG. 12 is an enlarged partial plan view of a lift strap in the support sling for the receptacle shown in FIG. 11.

Container 102 of receptacle 100 is supported by sling assembly 106. Sling assembly 106 comprises four lift straps 108 which are attached to container 102. In accordance with the preferred embodiment, each lift strap 108 is constructed entirely from two inch wide polyester webbing. As is best shown in FIG. 12, each lift strap 108 includes a lift loop 110 at one end thereof and a relatively smaller guide loop 112 at the opposite end. Lift straps 108 are sewn to the outside of container 102, so that lift loops 110 extend beyond the top end of container 102, with guide loops 112 positioned in spaced relationship inside the bottom periphery of container 102. Preferably, one lift strap 108 is wrapped over each seam between adjacent panels 104 and sewn along stitch line 114 as shown in FIG. 11. Consequently, this means of attaching lift straps 108 simultaneously reinforces the seams between panels 104. Where less than four panels 104 comprise container 102, lift straps 108 can be wrapped over a pinched or folded portion of adjacent panels 104 prior to sewing to achieve a sturdy construction. Either of these means of sewing lift straps 108 to container 102 functions to distribute the loading stresses between container 102 and sling assembly 106.

With lift straps 108 attached to container 102 as described above, draw rope 116 is passed through guide loops 112 to complete sling assembly 106. By means of draw rope 116, the bottom portion of container 102 can be supported in surrounding relationship with wire tie 118 as shown in FIG. 11. Wire tie 118 is used to close the bottom end of container 102. It will thus be apparent that when the discharge end of receptacle 100 is gathered and closed with wire tie 118, the bottom of container 102 is supported by draw rope 116. Consequently, draw rope 116 in sling assembly 106 performs a function similar to tension ring 88 in receptacle 10. When it is desired to discharge the contents of receptacle 100, wire tie 118 is removed, and draw rope 116 is loosened so as to permit discharge of the contents through the bottom of container 102. Thus, the bottom cross-section of container 102 can serve as the discharge spout, whereby materials which would otherwise bridge or clog a smaller discharge spout can be easily unloaded. However, all control of the discharge is not forsaken, since the discharge can be controlled to some extent with draw rope 116. A loop 120 can be attached to receptacle 100, if desired, as a convenient means for holding the ends of draw rope 116 out of interference. Finally, the top or fill end of receptacle 100 can be gathered and tied with a wire tie 122, for example.

Figure 14:
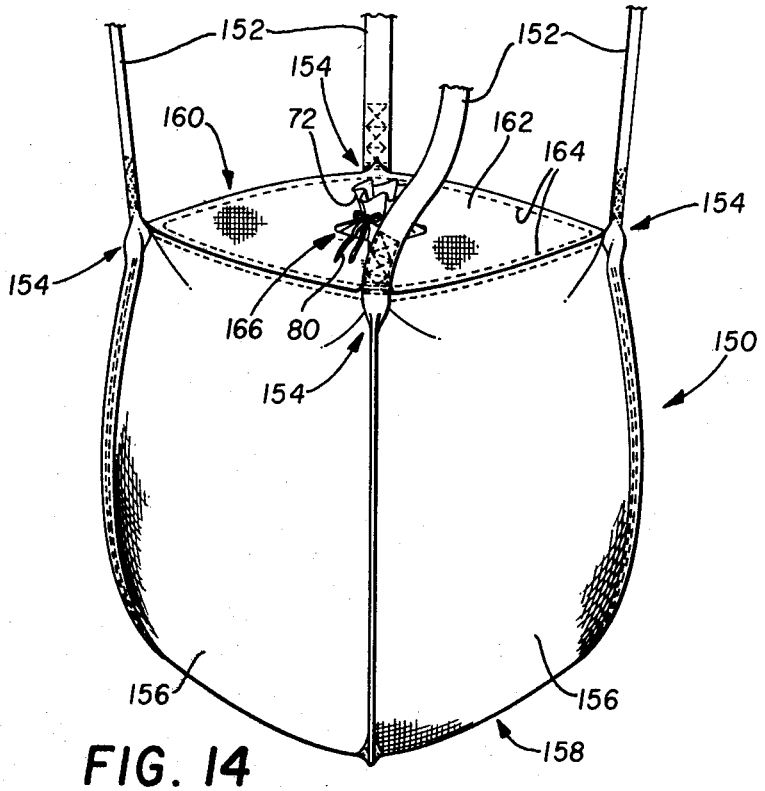
FIG. 14 is a perspective view of a flexible receptacle incorporating an improved strap attachment at the upper end of the receptacle.

Referring now to FIG. 14, there is shown a perspective view of a receptacle 150 embodying the present invention in which the straps 152 are attached at the upper corners 154 in an improved construction and extend beyond the upper end of receptacle 150 for lifting and supporting the receptacle. Straps 152 are connected along side panels 156 in the manner previously described, and the bottom 158 of receptacle 150 may be constructed as shown in FIGS. 1 and 2 or 11. The side panels 156 may be constructed from one continuous sheet of flexible material or from a plurality of sheets. The upper end 160 of the receptacle 150 includes a top panel 162 sewn at its outer edge to the upper edge of the receptacle 150 by a top seam 164. For ease of manufacture, the top panel 162 is preferably square, but many panel configurations are suitable for use in the invention as previously described. The bottom of receptacle 150 is constructed as previously described except that the bottom panel is also square. The top panel 162 includes an opening 166 that is constructed including a spout assembly 70 shown in FIGS. 1, 2 and 10 and is used to introduce flowable materials into the receptacle 150. A cross is burned in the bottom panel 46 (FIG. 1) and a circle is burned in the top panel 162 to form the opening 166 for the spout 72.

Figure 15:
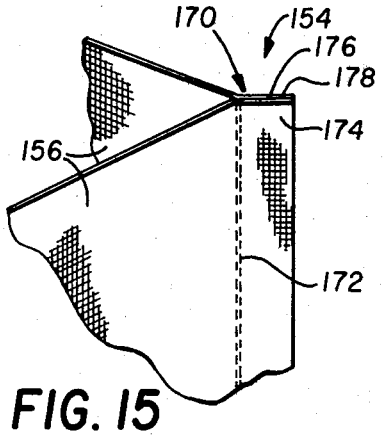
FIG. 15 is a detail view of a corner formed by side panels of the receptacle showing a side seam.

In FIG. 15, there is shown a corner detail of receptacle 150 prior to the attachment of strap 152 and top panel 162 as shown in FIG. 14. In this view, two side panels 156 are positioned with their vertical edges adjacent and are sewn together along a side seam 170 formed by a side seam stitch 172. The side seam 170 includes a seam flap 174 that is formed from two parallel flap portions 176 and 178 that extend outwardly from the side panels 156. Seam flap 174 may also be formed by folding a vertical portion of side panels 156 as shown in FIG. 8 and described in connection therewith.

Figure 16:
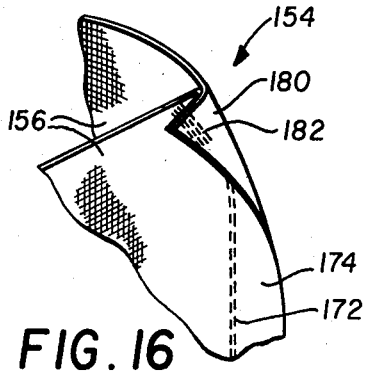
FIG. 16 is a detail view of a receptacle corner showing the upper end of the side seam flap folded and stitched to the side panel.
Figure 17:
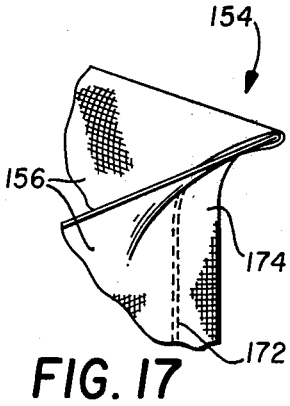
FIG. 17 shows the corner of the receptacle deformed for attaching a top panel.

Referring now to FIGS. 16 and 17, a detailed view of corner 154 depicts the steps necessary to prepare the corner 154 for attachment of the top panel 162 and the straps 152. First, the upper end 180 of the seam flap 174 is folded against a side panel 156 and secured thereto by stitching 182. The function of stitching 182 is to maintain the corner 154 in its folded position during the assembly of the receptacle 150. It is to be understood that other fasteners such as tape or staples may also be appropriate for this function. As shown in FIG. 17, the corner 154 and the upper edges of side panels 156 are then deformed to curl outwardly in preparation for sewing the top panel 162 onto the side panels 156.

Figure 18:
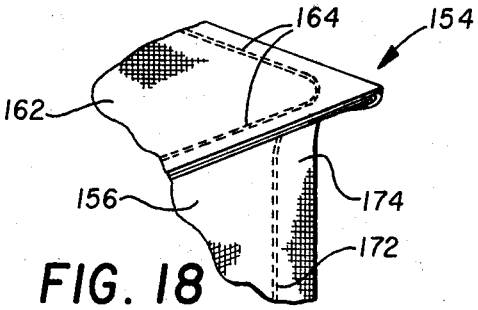
FIG. 18 shows a corner of the receptacle with a top panel sewn thereon.

Referring now to FIG. 18, there is shown a somewhat diagrammatical view of the corner 154 with the top panel 162 sewn thereto. Panel 162 is attached to the side panels 156 by a top seam 164 extending through the outer edge of top panel 162 and the upper edge of the side panels 156. Referring now to FIGS. 16, 17 and 18, it will be appreciated that the top seam 164 also secures the upper end 180 of the side seam flap 174 to the side panel 156. It will be understood that the deformation and exact configuration of the corner 154 and the receptacle 150 during the process of assembly may assume many different forms because of the flexible nature of the material from which the receptacle 150 is constructed. The figures shown herein are diagrammatical and somewhat exaggerated for clarity of illustration.

Figure 19:
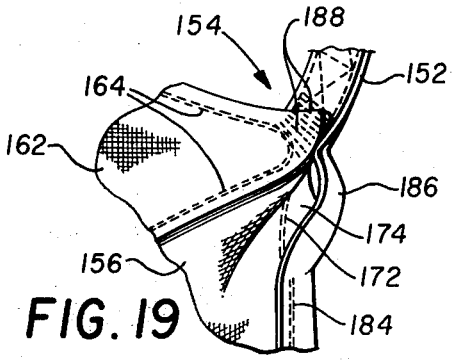
FIG. 19 shows the lifting strap stitched to the corner of the receptacle and to the side seam flaps.

Referring now to FIG. 19, there is shown the corner 154 with the strap 152 attached thereto. Strap 152 is folded lengthwise and positioned over the seam flap 174, such that the two longitudinal edges of the strap 152 are positioned on either side of the seam flap 174. The strap 152 is secured by a strap stitch 184 that extends through both longitudinal edges of the strap 152 and through the seam flap 174. The strap stitch 184 extends along the strap 152 and stops a predetermined distance below the upper edge of the side panels 156, and the strap 152 is unfolded or flared out along the predetermined distance and attached to the corner 154. An unattached slack portion 186 of strap 152 extends between the top of the stitch 184 and the top edge of side panel 156. The strap 152 is securely attached to the corner 154 by a top stitch 188 extending through the outer edge corner of the top panel 162 and through the upper edge corner formed by the side panels 156. The top stitch 188 also extends through the folded upper end 180 of the seam flap 174.

By referring to FIGS. 19 and 14, it will be appreciated that the straps 152 are connected to the receptacle 150 in a construction designed to resist tearing or ripping caused by oblique forces exerted through the straps 152 in a direction oblique to the side panels 156. When an outward oblique force is applied to the straps 152, the horizontal force is transmitted through the top stitch 188 to the top panel 162. Thus, the horizontal portion of the oblique force is distributed and resisted by a substantial portion of the top seam 164. Because of the slack portion 186 and the top stitch 188, very little horizontal force is applied to the strap stitch 184. Slack portion 186 is approximately 1½ to 2½ inches in length and is dimensioned to become taunt when an upward force is applied through straps 152. In this construction the interaction of the straps 152, the top stitch 188 and the top panel 162 prevents the straps 152 from being torn away from the side seam flaps 174 by forces applied through the straps 152 in a direction oblique to the side panels 156. However, as previously mentioned, the slack portion 186 is sufficiently taunt to transmit vertical forces, such that the upward or lifting force applied through the straps 152 is distributed along the straps 152 to apply vertical forces along the side panels 156 and the bottom 158 of the receptacle 150.

Thus, it is apparent that there has been provided in accordance with the invention a collapsible receptacle for flowable materials which fully satisfies the objects, aims and advantages set forth above. Although particular embodiments of the invention have been illustrated in the accompanying Drawings and described in the foregoing Detailed Description, it is expected that many alternatives, modifications and variations will be apparent to those skilled in the art. Accordingly, it will be understood that the invention is not limited to the embodiments disclosed, but is intended to embrace all such alternatives, modifications and variations as fall within the spirit and scope of the invention.

What is claimed is:

1. A collapsible receptacle for handling flowable materials, comprising:

a substantially flexible container having upper and lower ends and defining a collapsible chamber for the flowable materials;

said container including at least one side panel extending between the upper and lower ends of said container and forming a surrounding sidewall therefor;

the upper end of said container having a top panel peripherally attached to the side panel by a top seam;

said top panel including a closable opening for passing flowable materials therethrough; and a plurality of lift straps attached to said container arranged in spaced apart relationship and extending beyond the upper end of said container, said straps being secured to the top and side panels at the upper end of said container and being secured therealong to the side panel except over a portion of predetermined length adjacent the point of connection of said straps to said top panel, said straps thereby being operable to distribute lifting forces along said side panel so that said top panel resists forces applied through said straps in a direction oblique to said side panel to prevent said straps from being torn away from said side panel by the oblique forces.

2. The receptacle as set forth in claim 1 further comprising:

at least one side seam in the side panel extending between the upper and lower ends of said container; and one of said straps being folded along its length over said seam and attached to said side panel along a portion of said side seam.

3. The receptacle as set forth in claim 1 further comprising:

a plurality of side panels, arranged in edge to edge relationship each of said side panels having two longitudinal edges extending from the upper to the lower end of said container;

a plurality of side seams attaching the longitudinal edges of adjacent side panels together, said seams including side seam flaps formed by edge portions of said side panels extending outwardly from said container;

each of said lift straps being folded lengthwise over a portion of each of said side seams and secured thereto;

the upper end of each of said side seam edge portions being folded and sewn to the side panels by said top seam; and each of said straps being unfolded and secured to the upper edge of one of said side panels, the upper end of said side seam edge and portions the top panel.

4. The receptacle as set forth in claim 1 further comprising:

at least one sewn side seam on said side panel extending between the upper and lower ends of said container;

said sewn side seam including a side seam flap formed by at least one longitudinal edge portions of the side panel extending outwardly from said container; and said one strap having two longitudinal edges and being folded lengthwise over a portion of said side seam flap and sewn thereto with the longitudinal edges of said strap disposed on opposite sides of said side seam flap.

5. The receptacle as set forth in claim 4 wherein said strap is unfolded adjacent the upper end of the container with the top seam securing the upper edge of the side panel, the upper end of the side seam flap, and the outer edge of the top panel to said strap.

6. The receptacle as set forth in claim 4 wherein:

said side panel comprises a sheet of flexible material having two longitudinal edges sewn together along said side seam to form a collapsible chamber; and said side seam flap comprises two longitudinal portions of flexible material adjacent the longitudinal edges of said side panel and extending outwardly from said side seam.

7. The receptacle as set forth in claim 6 further comprising:

at least one folded side seam extending between the upper and lower ends of said container and spaced apart from said sewn side seam, said folded seam including a folded seam flap extending outwardly from said container formed by a longitudinally folded portion of said side panel;

a second strap folded lengthwise over said folded seam flap and sewn thereto; and a second top stitch for securing said second strap to the upper edge of said side panel and to the outer edge of said top panel.

8. The receptacle as set forth in claim 7 further comprising:

a plurality of folded side seams spaced apart about said container and extending between the upper and lower ends of said container;

said straps each having two longitudinal edges, with each of said straps being folded longitudinally over each of said folded seam flaps with the longitudinal edges of said straps on opposite sides of said folded seam flaps and sewn to said folded seam flaps; and a plurality of top stitches for securing each of said straps to the upper edge of said side panel and to the outer edge of said side panel.

9. A collapsible receptacle for handling flowable materials, comprising:

a substantially flexible container having upper and lower ends and defining a collapsible chamber for the flowable materials;

a plurality of side panels forming a side wall of the container and being defined by a plurality of side seams extending between adjacent side panels from the upper to the lower ends of said container;

a plurality of side seam flaps, each of said flaps extending along a separate one of said side seams and extending outwardly from said container;

a top panel sewn to the upper end of said container by a top seam extending along the upper edges of said side panels and along the outer edge of said top panel forming a closed upper end of said container, said side seam flaps being folded against and sewn to said side panels by said top seam;

said top panel including a closeable opening for introducing flowable materials into said container; and a plurality of lift straps, each of said lift straps being folded lengthwise and positioned over a separate one of said side seam flaps with sewn strap stitches securing said straps to said seam flaps along at least a portion of said seam flaps, said strap stitches extending continuously from the lower end of said container to a point positioned a predetermined distance below the upper end of said container thereby providing an unsecured, relieved strap portion in each strap;

the upper portions of said straps extending beyond the upper end of said container for applying a lifting force to said container;

said straps being sewn to the upper end of the container above the relieved portion and through the outer edge of said top panel, the upper edges of said side panels, the side seams, said side seam flaps and said straps, so that said straps are operable to distribute lifting forces along said side panels, and to transmit oblique forces applied through said upper portions of said straps in a direction oblique to said side panels into said top panel to prevent said side straps from being torn away from said side seam flaps by the oblique forces.

10. In a collapsible receptacle of the type having a plurality of longitudinally extending lift straps secured to a container in circumferentially spaced relationship, the container including an upstanding side panel with a separate top panel having an opening and peripherally secured across the upper end of the side panel and having a closed bottom, the improvement which comprises:

each of said lift straps being secured to the top and side panels at the upper end of said container; and each of said lift straps being secured along the lower portion thereof to the side panel up to a point located a predetermined distance below the upper end of the container such that an unsecured portion of each strap is provided adjacent to the point of connection of said strap to said top panel so that said straps are operable to distribute lifting forces along said side panel, and to transmit oblique forces applied through said upper portions of said straps in a direction oblique to said side panel into said top panel to prevent said side straps from being torn away from the receptacle by the oblique forces.

11. The collapsible receptacle of claim 10, wherein the lower portions of said lift straps are folded lengthwise over adjacent portions of the side panel and are secured therethrough.

* * * * *